US006339889B1

(12) United States Patent
Griesemer et al.

(10) Patent No.: US 6,339,889 B1
(45) Date of Patent: Jan. 22, 2002

(54) SPRING BIASED ASSEMBLY FOR MOUNTING FLEXIBLE SHEET ON STRUCTURE

(75) Inventors: Daniel A. Griesemer, Sandy; Paul F. Bauer, Layton, both of UT (US)

(73) Assignee: Mobile Impact, Inc., Layton, UT (US)

( * ) Notice: Subject to any disclaimer, the term of this patent is extended or adjusted under 35 U.S.C. 154(b) by 0 days.

(21) Appl. No.: 09/397,467

(22) Filed: Sep. 16, 1999

Related U.S. Application Data

(63) Continuation-in-part of application No. 09/274,948, filed on Mar. 23, 1999.

(51) Int. Cl.[7] ..... G09F 17/00
(52) U.S. Cl. ..... 40/603; 40/590; 160/378
(58) Field of Search ..... 40/603, 604, 590, 40/591; 160/328, 371, 378

(56) References Cited

U.S. PATENT DOCUMENTS

| | | | | | |
|---|---|---|---|---|---|
| 4,558,475 | A | | 12/1985 | O'Brien | 4/607 |
| 4,580,361 | A | | 4/1986 | Hillstrom et al. | 40/603 |
| 4,922,988 | A | * | 5/1990 | Loomis | 160/378 X |
| 5,044,102 | A | | 9/1991 | Finch et al. | 40/603 |
| 5,046,545 | A | | 9/1991 | Loomis et al. | 160/368.1 |
| 5,077,924 | A | | 1/1992 | Yamaguchi | 40/603 |
| 5,140,765 | A | | 8/1992 | King | 40/603 |
| 5,255,466 | A | | 10/1993 | Synder | 40/603 |
| 5,349,772 | A | | 9/1994 | Pardue | 40/590 |
| 5,373,653 | A | * | 12/1994 | Suzuki | 40/603 |
| 5,373,655 | A | | 12/1994 | Suzuki | 40/603 |
| 5,408,770 | A | | 4/1995 | Suzuki | 38/102 |
| 5,507,109 | A | | 4/1996 | Rinzler | 40/603 |
| 5,685,099 | A | * | 11/1997 | Favata | 40/590 |
| 5,845,423 | A | | 12/1998 | Hicks | 40/603 |
| 6,041,535 | A | * | 3/2000 | Holloway et al. | 40/603 |

* cited by examiner

*Primary Examiner*—Brian K. Green
*Assistant Examiner*—James M Hewitt
(74) *Attorney, Agent, or Firm*—Workman, Nydegger & Seeley

(57) ABSTRACT

A mounting assembly includes an elongated mounting bracket and an elongated retention bracket. The mounting and retention brackets are configured for ridged attachment to the side of a structure, such as by bolts. A coupling channel extends along the length of the mounting bracket and communicates with the exterior through a narrow mouth. The coupling channel is configured to slidably receive and retain the top edge of a display sheet. The retention bracket has a plurality of spaced apart holes transversely extending therethrough. Each hole is configured to receive a corresponding spring. Each spring has a first end configured for attachment to the bottom edge of the display sheet. Once the spring is attached to the display sheet, the second end of the spring is passed through the corresponding hole on the retention bracket. A pin is then secured to the second end of the spring, thereby securing the display sheet between the mounting bracket and the retention bracket under the biased tension of the springs.

30 Claims, 4 Drawing Sheets

SPRING BIASED ASSEMBLY FOR MOUNTING FLEXIBLE SHEET ON STRUCTURE

The present application is a continuation-in-part of U.S. patent application Ser. No. 09/274,948, filed Mar. 23, 1999 which for purposes of disclosure is incorporated herein by specific reference.

BACKGROUND OF THE INVENTION

1. The Field of the Invention

The present invention relates to mounting assemblies for flexible sheets and, more specifically, assemblies for mounting flexible sheets under spring biased tension on any desired structure.

2. Present State of the Art

Billboards are a popular and effective advertising medium. A conventional billboard comprises an enlarged upstanding frame having an expansive plain or board attached thereto. Advertising can be painted directly onto the face of the board. More commonly, however, advertising is printed or silkscreened onto enlarged vinyl or paper sheets which are then secured to the board by an adhesive. Most billboards are located adjacent to a freeway or other roadway so as to maximize public exposure.

Although conventional billboards are effective, the demand for additional advertising has promoted the need to find unique ways and locations for displaying advertising. For example, there is an increased demand for affixing advertising onto the side of buildings or other previously standing structures. The problem encountered, however, is that it is often difficult, and at times undesirable, to mount a conventional display board onto the side of such structures. Furthermore, many zoning and building restrictions preclude the attachment of a display board onto the side of buildings. The display boards are often rejected on the grounds that the display boards comprise a separate element that extends too far from the side of the building. Similarly, it is often impractical or undesired to secure an advertising sheet directly onto the side of a building or structure by an adhesive. Often, the side of the building is insufficiently flat to secure the advertising sheet. Furthermore, use of the adhesive can mare the building surface.

Additional desired advertising space is found on the side of vehicles such as buses, automobiles, and tractor trailers. Here again, legislation precludes the attachment of large display boards onto the side of vehicles. Such boards are often rejected on the grounds that the boards project too far from the side of the vehicles. In one approach to overcome this limitation, silkscreen or other printed advertising sheets have been made for direct attachment onto the side of a vehicle by an adhesive. Such advertising sheets, however can be difficult and labor intensive to attach and remove. Furthermore, the removal of such sheets can pull off the vehicle paint.

Although vinyl advertising sheets can simply be directly bolted to the side of a trailer or vehicle, conventional bolting makes it difficult to adequately stretch or tension the sheets so that they have a flat uniform appearance. Furthermore, it is often desirable to quickly exchange or replace advertisement sheets. This is particularly important with regard to truck trailers wherein the advertising sheets must be replaced during the period in which the trailer is being either loaded or unloaded. Conventional mounting systems are often labor intensive and time consuming in the replacement process. Furthermore, conventional mounting systems can be relatively heavy and occupy a considerable portion of available space. This can be problematic on truck trailers where advertising space is limited and it is desirable to minimize extra weight.

In one attempt to overcome some of the above problems, conventional cranks have been mounted onto the side of a truck trailer. Advertising sheets are formed having straps projecting from the side thereof. Accordingly, by tightening the straps through the cranks, the advertising sheets can be secured to the side of the trailer. Such an assembly, however, requires specially made advertising sheets wherein the straps must be aligned with the cranks. Furthermore, the cranks can produce localized stresses on the advertising sheets at the site of the straps, thereby producing an uneven appearance. Finally, the cranks project relatively far from the side of the trailer, thereby decreasing the aesthetic appearance and increasing the potential danger to those standing adjacent to the trailer.

An additional problem with cranks and other conventional systems used to removably secure advertising sheets is that such systems do not account for the expansion or contraction of the advertising sheets. That is, depending on the type of material an advertising sheet is comprised of, the advertising sheet can expand when exposed to hot weather. Expansion of the advertising sheet can result in the advertising sheet becoming wavy or flapping in the wind, thereby distracting from its appearance. Conventional systems require that the advertising sheet be manually retightened to prevent such sagging.

OBJECTS AND BRIEF SUMMARY OF THE INVENTION

Accordingly, it is an object of the present invention to provide improved assemblies for mounting flexible sheets onto a desired structure.

Also an object of the present invention is to provide assemblies as above which are configured to easily tighten a flexible sheet on the structure.

Another object of the present invention is to provide assemblies as above wherein the assembly lies adjacent to and flush against the structure.

Yet another object of the present invention is to provide assemblies as above which enable the flexible sheet to be mounted adjacent to the structure.

Another object of the present invention is to provide assemblies as above which enable quick and easy replacement of the flexible sheet.

Still another object of the present invention is to provide assemblies as above which minimize weight and occupy minimal space.

Also an object of the present invention is to provide assemblies as above which continually maintain the display sheet tightly tensioned as the display sheet expands and contracts under weather conditions.

Finally, an object of the present invention is to provide assemblies as above which can be mounted on the side of buildings, vehicles, or other desires structures while complying with corresponding regulations.

To achieve the foregoing and other objects, and in accordance with the invention as embodied and broadly described herein, a mounting assembly is provided for removably securing a flexible display sheet to a structure such as the side of a building or vehicle. The display sheet has a front face that extends to an encircling perimeter edge. Secured at the perimeter edge is a small diameter retention line. The display sheet is configured such that advertising can be printed, silkscreened, or otherwise disposed on the front face thereof The mounting assembly includes an elongated mounting bracket and an elongated retention bracket. The mounting bracket and retention bracket are ridgedly attached flush to the side of a structure in spaced apart parallel alignment. A coupling channel extends along the length of the mounting bracket and communicates with the exterior through a narrow mouth. The coupling channel is configured to slidably receive and retain a top edge of the display sheet.

The retention bracket has a plurality of spaced apart holes transversely extending therethrough. Each hole is configured to receive a corresponding spring. Each spring has a first end selectively attached to a bottom edge of the display sheet. Once a spring is attached to the display sheet, the second end of the spring is pulled through a corresponding hole on the retention bracket. A pin is then secured to the second end of the spring, thereby securing the display sheet between the mounting bracket and the retention bracket under the biased tension of the springs.

If desired, a similar assembly can also be mounted along the sides of the display sheet so as to also horizontally tension of the display sheet. Once the display sheet is tensioned, comer brackets can be mounted to the mounting brackets and retention brackets so as to cover and protect the comers of the display sheet.

The inventive mounting assembly has a variety of benefits over conventional systems. For example, as a result of the mounting bracket and retention bracket each being disposed flush against the structure, the mounting assembly projects only a minimal distance from the structure. As a result, the mounting assembly creates a minimal potential hazard and is generally acceptable under current regulations for placement on the side of vehicles and buildings.

Furthermore, as a result of the mounting assembly being positioned flush against the structure, the display sheet secured thereto is also mounted substantially flush against the structure. In one embodiment, the mouth extending from the coupling channel on the mounting bracket faces towards the structure so that the display sheet is disposed directly adjacent to the structure.

The inventive mounting assembly is also unique in that once the assembly is mounted on a structure, the display sheet can be easily and quickly replaced. That is, by simply releasing and removing the springs, the display sheet can be easily slid out of the coupling channel on the mounting bracket. A new display sheet can then be slid back into the coupling channel and secured by the springs to the retention bracket.

Another benefit of the present invention is that the display sheet is held tight under the tensioning force of the expanded springs. As a result, even when the display sheet expands or contacts based on weather conditions, the display sheet is continually held under tension.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
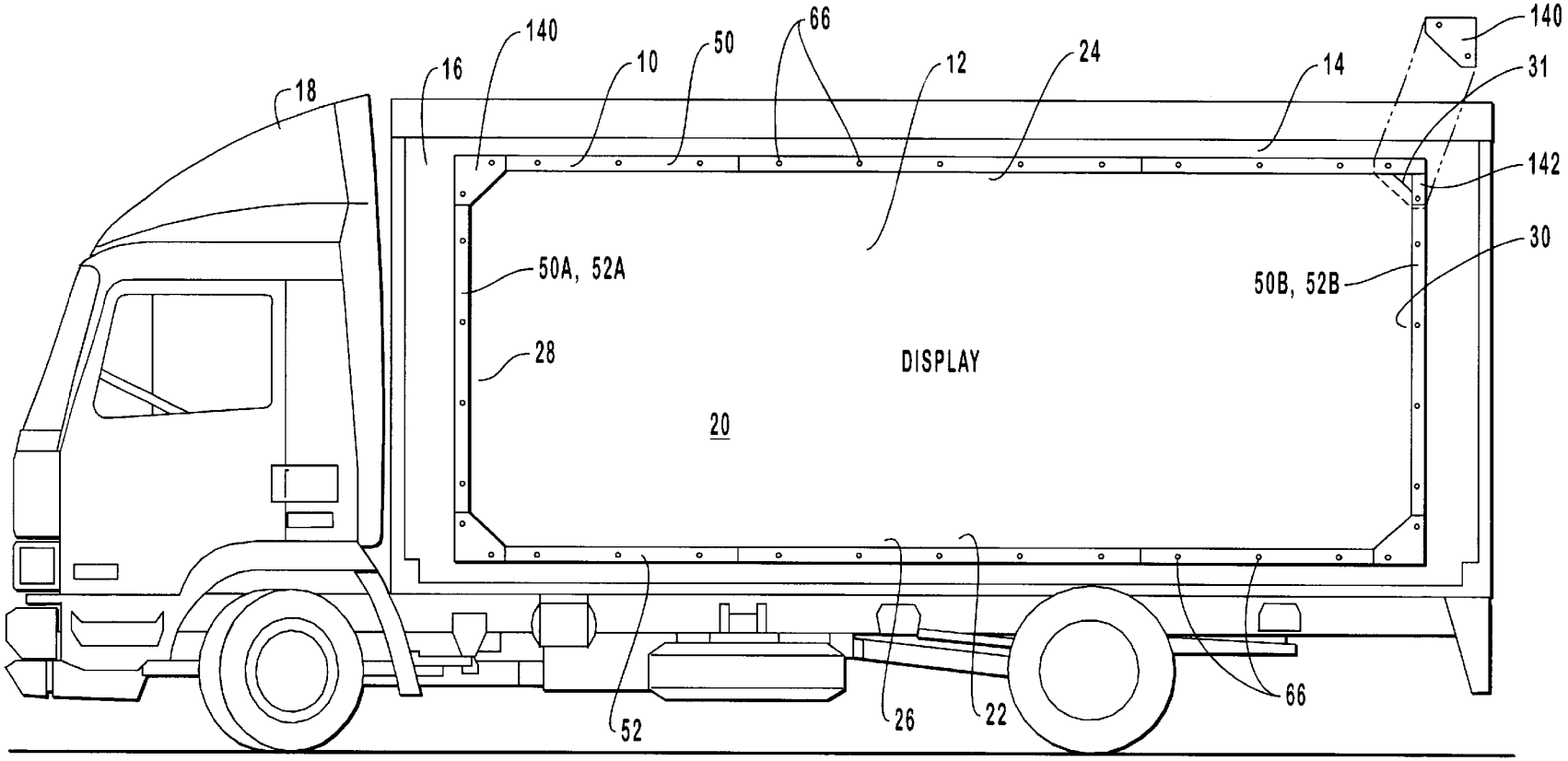
FIG. 1 is a side view of the inventive mounting assembly securing a flexible display sheet to the side of a truck.

Depicted in FIG. 1 is one embodiment of an inventive mounting assembly 10 incorporating features of the present invention. Mounting assembly 10 is configured for securing a flexible display sheet 12 to a structure 14. In the embodiment depicted, structure 14 comprises a side 16 of a cargo truck 18. As used in the specification and appended claims, the term "structure" is broadly intended to include any type of structure on which it is desired to mount a display. By way of example and not by limitation, the structure can include a trailer, bus, automobile, wall, building, support frame, billboard, and the like.

Display sheet 12 has a front face 20 that extends to a perimeter edge 22. Although display sheet 12 can have any desired configuration, in the embodiment depicted, display sheet 12 has a substantially rectangular configuration wherein perimeter edge 22 includes a top edge 24, a bottom edge 26, and opposing side edges 28 and 30. Although not required, display sheet 12 can have cut comers 31.

Figure 2A:
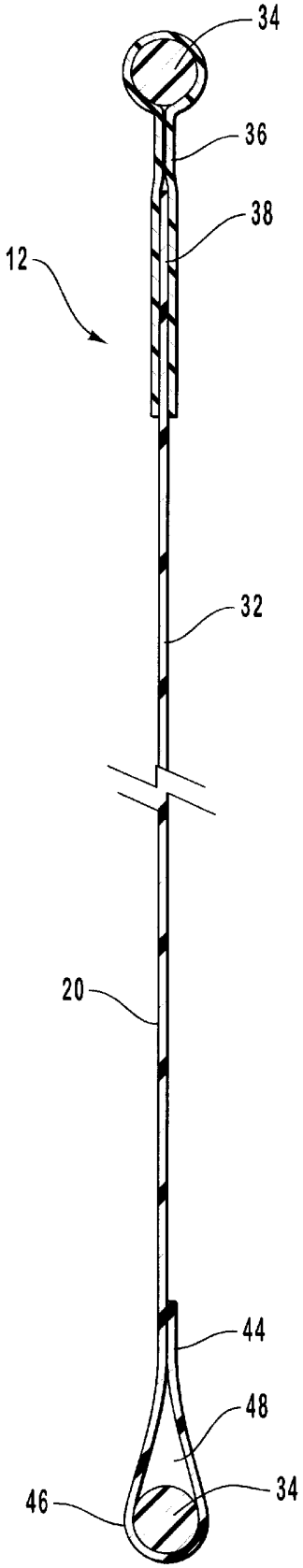
FIGS. 2A–2C are cross sectional side views of alternative display sheets shown in FIG. 1.

In the embodiment depicted in FIG. 2A, display sheet 12 comprises a display portion 32; retention line 34; and means for securing retention line 34 to the perimeter edge of display portion 32. Display portion 32 can be made of any sheet-like material such as paper, extruded sheets such as vinyl, or woven fabrics such as cotton, nylon, or other synthetic materials. Advertising, logos, signs, pictures, drawings, or any other printing can be positioned on display portion 32 such as by conventional printing, adhesion, silk screening, or drawing.

Retention line 34 has a diameter that is greater than the thickness of display portion 32. As used in the specification and appended claims, the term "retention line" is broadly intended to include relatively small diameter elongated members which can be either flexible or rigid. In one embodiment, retention line 34 comprises an extruded flexible plastic line. In alternative embodiments, retention line 34 can comprise a dowel or stylet made from materials such as wood, plastic, or metal; cord; tubing; rolled material; and the like. Retention line 34 can have a circular, square, rectangular, or any other polygonal or irregular transverse cross section.

As depicted at the top end of FIG. 2A, one embodiment of the means for securing retention line 34 to display portion 32 includes a sleeve 36 having opposing ends folded together so as to enclose retention line 34 and an edge 38 of display portion 32 therebetween. Sleeve 36 has an inside coating of a heat sealing material. Accordingly, as heat is applied to sleeve 36, sleeve 36 bonds to retention line 34 and display portion 32. Sleeve 36 and retention line 34 can be purchased as an integral unit referred to as Keder material which is available from Seattle Industrial Textile Company out of Seattle, Wash.

Figure 2B:
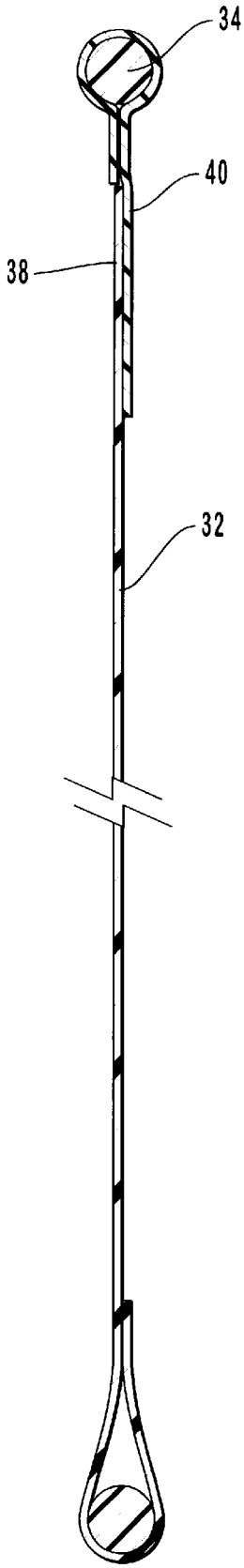

In the alternative to using a heat sealing material with sleeve 36, other adhesives, staples, stitching, and other conventional mechanisms can also be used to secure sleeve 36 to display portion 32. In another alternative, as depicted in FIG. 2B, a single sided sleeve 40 can be used to secure retention line 34 to edge 38. As a result, only one side of display portion 32 is secured to sleeve 40. Single sided sleeve 40 can be easier to align and attach to display portion 32.

Figure 2C:
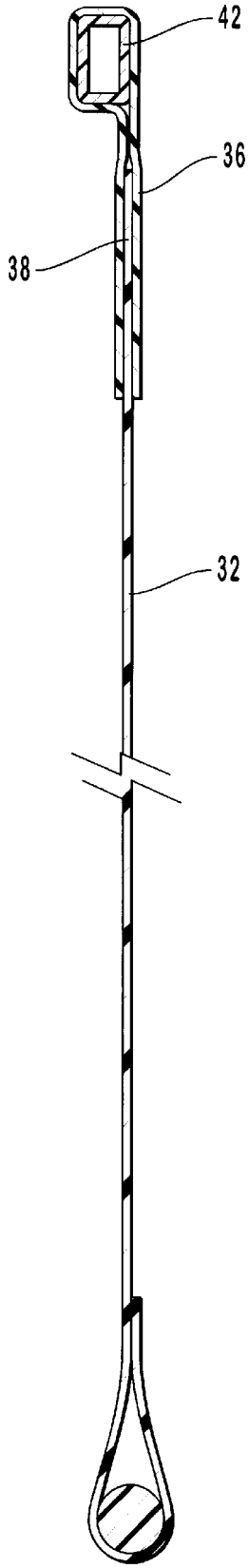

Depicted in FIGS. 2A and 2B, retention line 34 has a substantially circular transverse cross section. As depicted in FIG. 2C, sleeve 36 can also be used to secure a retention line 42 having a substantially rectangular transverse cross section or any other desired shape.

In contrast to using a separate sleeve to attach retention line 34, as depicted at the lower end of each of FIGS. 2A–2C, a lower edge 44 of display portion 32 is folded over to form a loop 46 bounding an elongated compartment 48. Lower edge 44 can be secured to display portion 32 such as by stitching, staples, adhesive, or the like. Once loop 46 is formed, retention line 34 is selectively slid into or out of compartment 48. In the alternative to using loop 46, retention line 34 can be directly secured to lower edge 44 of display portion 32 by stitching, staples, adhesives, or the like.

The present invention also envisions that display sheet 12 need not include a discrete retention line or sleeve. For example, the perimeter edge of display sheet 12 can be substantially flat. As such, display sheet 12 can have a continuous sheet-like configuration. Alternatively, the edges of a display sheet 12 can be rolled up or bunched to form a retention line thereat.

Figure 3:
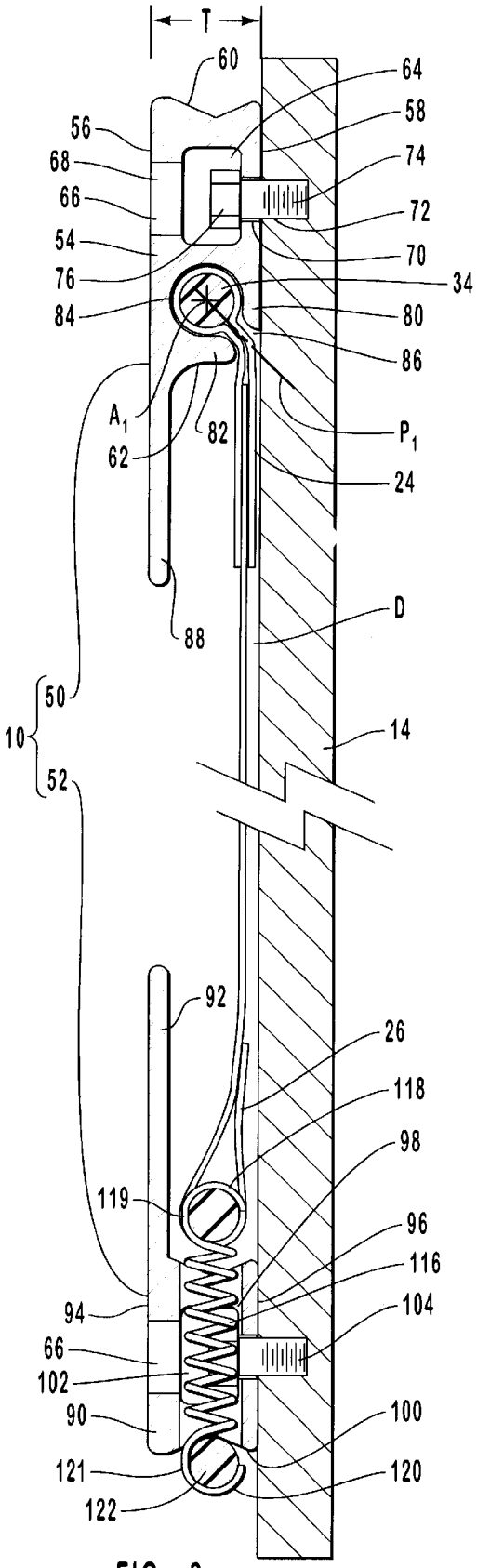
FIG. 3 are cross sectional side view of the mounting assembly shown in FIG. 1.

Depicted in FIG. 3, mounting assembly 10 includes a mounting bracket 50 and a retention bracket 52. In one embodiment, brackets 50 and 52 are elongated members that are manufactured by extruding and drilling. The members are typically made from aluminum or plastic but can also be made from other materials. Brackets 50 and 52 typically each have a length in a range between about 1 meter to about 3 meters with about 2 meters to about 2.5 meters being more preferred. Typically, members of about 2.5 meters or less are preferred for ease in delivering the assembly through the mail. Brackets 50 and 52 are configured for securing and tensioning display sheet 12 on structure 14 and for simultaneously cover the perimeter edge of display sheet 12.

In one embodiment of the present invention, attachment means are provided for removably securing a first edge of display sheet 12 to a structure. By way of example, as depicted in FIG. 3, mounting bracket 50 has a body 54. Body 54 includes a front face 56 and an opposing back face 58 each extending between a top side 60 and an opposing bottom side 62. Longitudinally extending through body 54 is a central bore 64. As depicted in FIGS. 1 and 3, transversely extending between front face 56 and back face 58 in alignment with central bore 64 are a plurality of spaced apart bolt holes 66. Each bolt hole 66 includes a first portion 68 extending from front face 56 to central bore 64 and a concentrically disposed second portion 70 extending from central bore 64 to back face 58. First portion 68 has a diameter greater than the diameter of second portion 70.

A bolt 72 is disposed within each bolt hole 66 such that a threaded shaft 74 of bolt 72 passes through second portion 70 so as to threadedly engage with structure 14. An enlarged head 76 of bolt 72 is configured to pass through first portion 68 and rest against the surface bounding central bore 64. By tightening each of bolts 72, back face 58 of mounting bracket 50 is secured flush against structure 14.

Body 54 also includes an elongated finger 80 formed along a portion of back face 58 and an elongated thumb 82 formed along bottom side 62. Finger 80 and thumb 82 bound a coupling channel 84 that runs along the length of mounting bracket 50. Coupling channel 84 has a substantially circular transverse cross section and communicates with the exterior through a narrow mouth 86. Coupling channel 84 is configured to slidably receive retention line 34 such that sleeve 36 passes through mouth 86. Retention line 34 has a diameter larger than mouth 86 so as to prevent retention line 34 from passing therethrough. As discussed later in greater detail, coupling channel 84 can have a square, rectangular, or any other polygonal or irregular configuration.

One of the unique features of mounting bracket 50 is that mouth 86 is configured to open towards structure 14 when back face 58 of mounting bracket 50 is disposed against structure 14. Specifically, mouth 86 is configured such that a plane P, projecting from a central longitudinal axis A, of coupling channel 84 centrally through mouth 86 intersects structure 14 when back face 58 of mounting bracket 50 is disposed against structure 14. Accordingly, a portion of display sheet 12 passing through mouth 86 is angled to intersect with structure 14. This positioning of mouth 86 minimizes the distance D between display sheet 12 and structure 14. In one embodiment, the maximum distance D between display sheet 12 and structure 14 is typically less than about 3 cm with less than about 2 cm being preferred and less than about 1 cm being more preferred.

The present invention also envisions a variety of other embodiments for removably securing a first edge of display sheet 12 to a structure. For example, an elongated bracket can be used such that bolts or screws are passed directly through both the bracket and display sheet 12 so as to secure display sheet 12 to structure 14. As discussed below in greater detail, mounting bracket 50 can also be replaced with retention bracket 52. In other embodiments, coupling channel 84 can be replaced with clips, clamps, hooks, fasteners, snaps, and the like that can be used to secure display sheet 12 to mounting bracket 50. In yet other embodiments, the attachment means can include the corresponding structure as disclosed in U.S. Pat. Nos. 4,558,475; 4,580,361; 5,044,102; 5,373,655; and 5,507,109 which are hereby specifically incorporated by reference.

Finally, mouth 86 can also be configured such that a plane projecting from central longitudinal axis A, of coupling channel 84 through mouth 86 is disposed substantially parallel with structure 14 and/or back face 58 of mounting bracket 50. Mouth 86 can also be disposed so as to outwardly open away from structure 14.

Mounting bracket 50 also includes an elongated plate like flange 88 projecting from bottom side 62 of body 54. Flange 88 is disposed in substantially parallel alignment with front face 56. Flange 88 functions to cover and protect top edge 24 of display sheet 12. Mounting bracket 50 has a maximum thickness T extending between front face 56 and back face 58 which is typically less than about 1.9 cm and more preferably less than about 1.4 cm. This thickness T is also the maximum distance that mounting bracket 50 projects from structure 14 when attached thereto.

Figure 4:
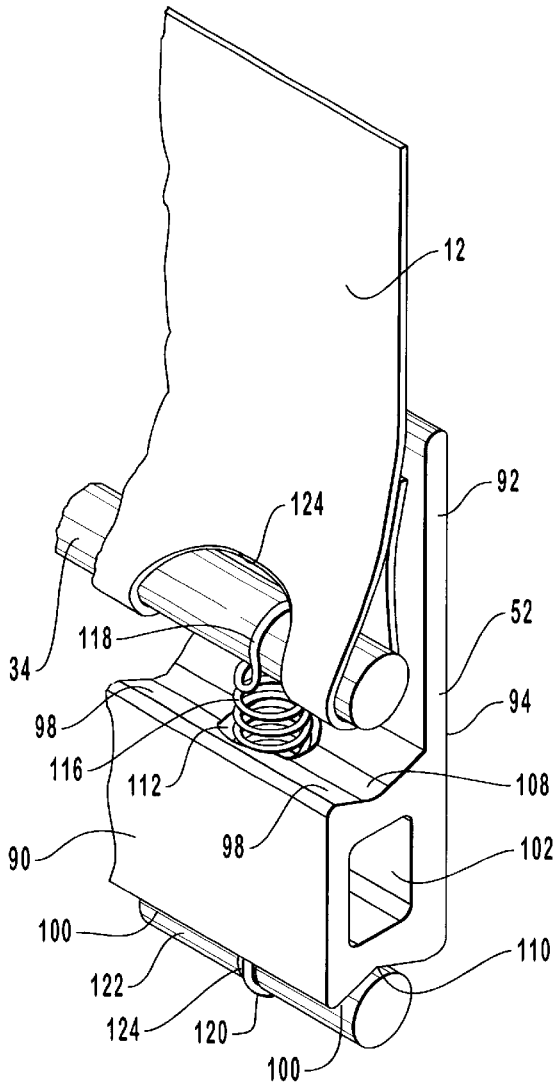
FIG. 4 is a perspective view of the retention bracket of the mounting assembly shown in FIG. 3.

As depicted in FIGS. 3 and 4, retention bracket 52 includes a body 90 having a flange 92 projecting therefrom. For ease in manufacturing, retention bracket 52 has a configuration substantially similar to mounting bracket 50. Specifically, body 90 has a front face 94 and a back face 96 each extending between a top side 98 and an opposing bottom side 100. Longitudinally extending through body 90 is a central bore 102. A plurality of spaced apart bolt holes 66 extend through retention bracket 52 in the same way as previously discussed above with regard to bolt holes 66 in mounting bracket 50. Bolt holes 66 are used by bolts 104 to secure retention bracket 52 to structure 14.

For reasons that will be discussed later in greater detail, a first recessed groove is longitudinally formed along the length of top side 98. Similarly a second recessed groove 110 is formed along the length of bottom side 100. Transversely extending between top side 98 and bottom side 100 are a plurality of spaced apart holes 112. Flange 92 projects from top side 98 and is in substantially parallel alignment with front face 94 of retention bracket 52.

In one embodiment of the present invention, means are provided for releasably securing bottom edge 26 of display sheet 12 to retention bracket 52 under a resiliently biased tension. By way of example and not by limitation, a spring 116 is provided having catch 118 formed at a first end 119 and a catch 120 formed at an opposing second end 121 thereof. In the embodiment depicted, catches 118 and 120 are each in the form of a hook. In alternative embodiments, catches 118 and 120 can comprise loops or other conventional catches. As depicted in FIG. 4, a plurality of spaced apart cut-outs 124 are formed on display sheet 12 so as to partially expose spaced apart sections of retention line 34. First catch 118 of spring 116 is looped over the exposed portion of retention line 34, thereby securing spring 116 to retention line 34.

Means are also provided for securing second end 121 of spring 116 at bottom side 100 of retention bracket 52. By way of example and not by limitation, spring 116 is disposed within hole 112 while second end 121 is pulled out through bottom side 110. Second catch 120 is then hooked over a brace such as elongated pin 122 having a length greater than the diameter of hole 112. Pin 122 has a central annular groove 124 in which second catch 120 is received. Second recessed groove 110 is configured to receive pin 122 in a nested configuration. In this configuration, each spring 116 is resiliently tensioned between retention line 34 and pin 122 such that display sheet 12 is tensioned between mounting bracket 50 and retention bracket 52.

Figure 5:
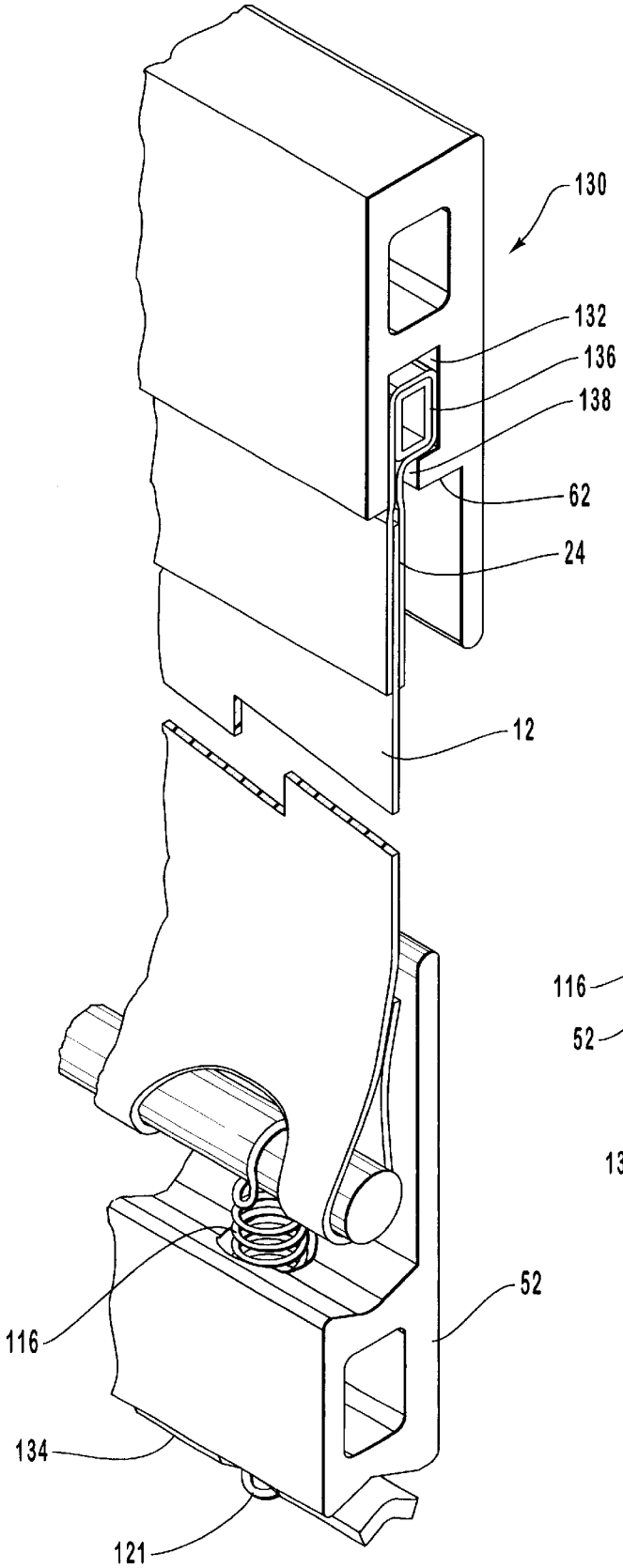
FIG. 5 is a perspective view of an alternative embodiment of the mounting assembly shown in FIG. 3.
Figure 6:
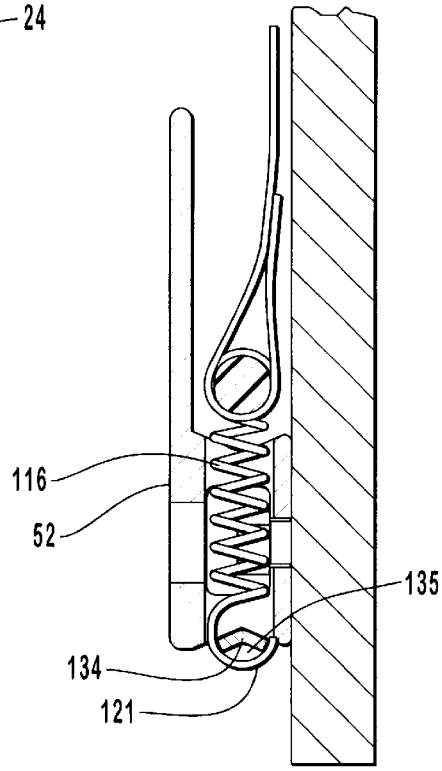
FIG. 6 is a cross sectional side view of the retention bracket shown in FIG. 5.

In the embodiment depicted, spring 116 is comprised of a coiled metal spring. In alternative embodiments, spring 116 can comprise a rubber or elastic band or bands having hooks or other catches formed at the opposing ends thereof. Furthermore, as depicted in FIGS. 5 and 6, a brace 134 is used to replace pin 122. Brace 134 comprises a narrow elongated plate that is bent in a substantially U or V shaped configuration along its width. As a result, a gap 135 is formed between the face of brace 134 and second end 121 of spring 116. As discussed below, gap 135 enables easy attachment of a tool to second end 121 of spring 116 during attachment and removal of brace 134. In other embodiments, pin 122 can be replaced by a brace of any desired structure, such as a ring, which can attached to second end 121 of spring 116 and will not pull through a corresponding hole 112. In yet another embodiment, the brace can be eliminated and bottom side 100 can be configured to directly catch second end 121 of spring 116. For example, a small pocket can be formed on bottom side 100 to receive the end of the hook positioned at second end 121 of spring 116.

In yet another embodiment, a bolt is positioned at second end 121 of spring 116 and passed through a corresponding hole 112. An enlarged nut is then threaded onto the bolt so as to bias against bottom side 100 of retention bracket 52. As the nut is tightened, display sheet 12 becomes tensioned between mounting bracket 50 and retention bracket 52.

Also depicted in FIG. 5 is an alternative mounting bracket 130. Mounting bracket 130 is similar to mounting bracket 50 and like elements are identified by like reference characters. Mounting bracket 130, however, is distinguished over mounting bracket 50 in that it contains a coupling channel 132 having a substantially rectangular transverse cross section that extends along the length of mounting bracket 130. Coupling channel 132 communicates with the exterior through a narrow mouth 138 that extends through bottom side 62. Slidably disposed within coupling channel 132 is a retention line 136 having a substantially rectangular transverse cross section.

Besides functioning as a passage for springs 116, holes 112 also serve as a drain. Once display 12 is attached to mounting bracket SO and retention bracket S2, as discussed above, water and dirt will accumulate through normal use between flange 29 of retention bracket 52 and display 12. First recessed groove 108 on retention bracket 52 collects the water and dirt and directs it to holes 112. The water and dirt then passes through holes 112 and away from mounting assembly 10.

Returning back to FIG. 1, mounting assembly 10 is assembled and used pursuant to the following steps which can be accomplished in a variety of different ordered sequences. In one method of assembly, one or more mounting brackets 50 are secured to structure 14 by screwing bolts 72 through corresponding spaced apart bolt holes 66 as previously discussed with regard to FIG. 3. Next, top edge 24 of display sheet 12 is attached to mounting brackets 50 by sliding retention line 34 through coupling channel 84. As a result, display sheet 12 is freely suspended by top edge 24 secured to mounting bracket 50.

Next, one or more retention brackets 52 are secured to structure 14 by screwing bolts 72 through corresponding spaced apart bolt holes 66 and into structure 14 as previously discussed with regard to FIG. 3. Retention brackets 52 are disposed such that when display sheet 12 is tightly drawn, bottom edge 26 is covered by flange 92 of retention bracket 52 and spaced apart from top side 98 of retention bracket 52. It is noted that mounting brackets 50 and retention brackets 52 need not be continuous. For example, shorter mounting brackets 50 and retention brackets 52 can be spaced apart in horizontal alignment, such as between corrugations on the side of a vehicle.

A plurality of springs 116 are then attached to retention line 34 along bottom edge 26 of display sheet 12 as previously discussed with regard to FIGS. 3 and 4. Springs 116 are spaced apart so that each spring 116 is in alignment with a corresponding hole 112 extending through retention brackets 52. Cut outs 124 make it easy to attached first end 119 of each spring 116 to retention line 34 and also allows lateral movement of springs 116 along the length of retention line 34, thereby enabling easy alignment of springs 116 with corresponding holes 112. In alternative embodiments, however, cut outs 124 are not required. First catches 118 can simply poke through display sheet 12 so as to engage retention line 34.

Next, a tool (not shown), such as a narrow elongated shaft having a hook at the end thereof, is upwardly passed through a hole 112 where it then attaches to second end 121 of a corresponding spring 116. The tool is then drawn back through the hole 112 so that second end 121 of spring 116 is exposed on bottom side 100 of retention bracket 52. Second catch 120 is then hooked over or otherwise attached to a corresponding brace such as pin 122 or brace 134. The tool is then released so that pin 122 or brace 134 is biased against retention bracket 52 by spring 116. In this position, spring 116 is resiliently expanded so that spring 116 produces a resilient bias force against display sheet 12. This same process is repeated along the length of retention brackets 52 such that the plurality of springs 116 produce a substantially uniform tensioning force that tightens display sheet 12 between mounting brackets 50 and retention brackets 52. In one embodiment, springs 116 are spaced apart in a range between about 15 cm to about 60 cm with about 30 cm to about 45 cm being more preferred.

In some embodiments, such as on the side of moving vehicles, it is desired to secure side edges 28 and 30 of display 12 to a structure. In the embodiment depicted in FIG. 1, retention brackets 52A are vertically secured to structure 14 adjacent to side edge 28 of display 12. Similarly, retention brackets 52B are vertically secured to structure 14 adjacent to side edge 30 of display 12. Spaced apart springs 116 are then used to secure side edges 28 and 30 to retention brackets 52A and 52B in substantially the same manner as previously discussed with regard to retention bracket 52. As a result, display sheet 12 is horizontally tensioned between retention brackets 52A and 52B.

In an alternative embodiment, one or both of retention brackets 52A and 52B can replaced with mounting brackets 50A and/or 50B. In this embodiment, top edge 24 of display sheet 12 is first slidable received within coupling channel 84 as previously discussed with regard to FIG. 3. Next, the retention lines secured to sides edges 28 and 30 of display sheet 12 are slidably received within the coupling channels of mounting brackets 50A and 50B. Bottom edge 26 is then attached to retention bracket 52 as previously discussed with regard to FIG. 3.

Once display sheet 12 is secured to the mounting and retention brackets, comer brackets 140 are secured, such as by bolting, over the intersection of the vertically and horizontally disposed retention and mounting brackets. Corner brackets 140 in part function to cover and protect any exposed corner 31 of display sheet 12. Corner brackets 140 also produce a more aesthetic appearance to the intersection of of the vertically and horizontally disposed retention and mounting brackets.

Replacement of display sheet 12 is easily and quickly accomplished using substantially reversed steps except that the retention and mounting brackets need not be removed from structure 14. Specifically, pins 122 are separated from springs 116 following which springs 116 are removed from retention brackets 52, 52A, and 52B, where applicable. With bottom edge 26 and side edges 28 and 30 freed, top edge 24 of display sheet 12 is simply slid out of coupling channel 84 so as to allow a new display sheet 12 to be slid therein.

As depicted in FIG. 1, in one embodiment, a short portion 142 of mounting bracket 50B or retention bracket 52B intersects with or is adjacent to mounting bracket 50. During the initial attachment or replacement of display sheet 12, short portion 142 is removed from structure 14. This enables free sliding of top edge 24 of display sheet 12 into coupling channel 84. Once top edge 24 is secured, short portion 142 is reattached. The benefit of using short portion 142 is that only one or two bolts need to be removed to detach short portion 142. In contrast, a significantly larger number of bolt would need to be removed if the full length of mounting bracket 50B or retention bracket 52B had to be removed and then reattached.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An assembly for mounting a flexible display sheet having a first edge and an opposing second edge to a structure, the assembly comprising:

(a) an elongated retention bracket configured for rigid attachment to the structure, the retention bracket having a hole transversely extending therethrough;

(b) a spring having a first end and an opposing second end, the spring being selectively disposed within the hole in the retention bracket, the first end of the spring being configured to couple with the second edge of the display sheet, and (c) means for securing the second end of the spring to the retention bracket, the means comprising a brace removably coupled with the second end of the spring such that the spring biases the brace against the retention bracket.

2. An assembly as recited in claim 1, further comprising attachment means for removably securing the first edge of the display sheet to the structure.

3. An assembly as recited in claim 2, wherein the attachment means comprises a mounting bracket having a channel disposed along at least a portion of a length thereof, the channel communicating externally through a narrow mouth, the channel and mouth being configured to slidably receive at least a portion of the first edge of the flexible sheet.

4. An assembly as recited in claim 1, wherein the retention bracket has a substantially L-shaped configuration comprising:

(a) an elongated body having a front face and a back face each extending between a top side and an opposing bottom side, the hole extending between the top side and the bottom side; and (b) a flange outwardly projecting from the front face of the body between the hole and the front face.

5. An assembly as recited in claim 1, wherein the brace comprises a discrete elongated pin.

6. An assembly as recited in claim 1, wherein the hole in which the spring is disposed extends between a front face on a first side of the retention bracket and a back face on an opposing second side of the retention bracket, the first end of the spring being disposed on the first side of the retention bracket, at least a portion of the second end of the spring openly exposed on the second side of the retention bracket during use.

7. An assembly for mounting a flexible sheet having a first edge and an opposing second edge to a structure, the assembly comprising:

(a) a mounting bracket configured for rigid attachment to the structure, the mounting bracket having a channel disposed along at least a portion of a length thereof and having a maximum inner diameter, the channel communicating external through a constricted narrow mouth having a width smaller than the maximum inner diameter of the channel, the channel and mouth being configured to slidably receive at least a portion of the first edge of the flexible sheet;

(b) a retention bracket configured for rigid attachment to the structure, the retention bracket having a body with a top side and an opposing bottom side, a plurality of spaced apart holes extend through the body between the top side and the bottom side;

(c) a spring having a first end and an opposing second end, at least a portion of the spring being selectively disposed within a corresponding hole of the retention bracket, the first end of the spring being configured for attachment to the second edge of the display sheet; and (d) means for securing the second end of the spring at the bottom side of the the retention bracket, the means comprising an elongated narrow plate having a substantially V-shaped bend across a width thereof.

8. An assembly as recited in claim 7, wherein the channel of the mounting bracket has a substantially circular transverse cross section.

9. An assembly as recited in claim 7, wherein the mounting bracket comprises:

(a) an elongated body having a front face and a back face each extending between a top side and an opposing bottom side; and (b) a flange outwardly projecting from the body.

10. An assembly as recited in claim 9, wherein the mouth to the channel is disposed at the intersection of the bottom side and front face of the body of the mounting bracket.

11. An assembly as recited in claim 7, wherein the retention bracket comprises a flange outwardly projecting from the top side thereof along a length of the retention bracket.

12. An assembly as recited in claim 7, further comprising a first grooved recess longitudinally formed on the top side of the retention bracket, the first grooved recess intersecting a hole of the spaced apart holes.

13. An assembly as recited in claim 7, further comprising a grooved recess longitudinally formed on the bottom side of the retention bracket, the grooved recess intersecting a hole of the spaced apart holes.

14. An assembly as recited in claim 7, wherein the spring comprises a coiled metal strand.

15. An assembly as recited in claim 7, wherein the means for securing the second end of the spring at the bottom side of the retention bracket comprises an elongated pin, the pin having a length greater than the diameter of a hole of the spaced apart holes.

16. An assembly for use on a structure, the assembly comprising:

(a) a display sheet having a first edge an opposing second edge;

(b) an elongated mounting bracket selectively secured to the first edge of the display sheet;

(c) an elongated retention bracket having a top side and an opposing bottom side, a hole extending between the top side and the bottom side;

(d) a spring having a first end and an opposing second end, the spring being disposed within the hole of the retention bracket, the first end of the spring being directly coupled with the second edge of the display sheet; and (e) a brace coupled with the second end of the spring such that the spring biases the brace against the bottom side of the retention bracket.

17. An assembly as recited in claim 16, wherein the display sheet comprises:

a display portion having the first edge and the second edge; and a retention line disposed along at least a portion of the second edge, the first end of the spring being coupled with the retention line.

18. An assembly as recited in claim 17, wherein the retention line has a substantially four sided transverse cross section.

19. An assembly as recited in claim 16, wherein the mounting bracket comprises:

(a) an elongated body having a channel formed therein, the channel communicating externally through a constricted narrow mouth; and (b) an elongated flange projecting from the body, the first edge of the display sheet being disposed between flange and the structure when the mounting bracket is secured to the structure.

20. An assembly as recited in claim 19, wherein the mouth of the mounting bracket is angled to face toward the structure when the mounting bracket is secured to the structure.

21. An assembly as recited in claim 16 wherein the spring is comprised of an elastomeric material.

22. An assembly as recited in claim 16, wherein the brace comprises an elongated pin.

23. An assembly as recited in claim 16, wherein at least a portion of the first end of the spring directly passes through at least a portion of the display sheet.

24. A method comprising the acts of:

(a) securing the top edge of a display sheet within a channel formed on mounting bracket such that the display sheet is supported by the mounting bracket, the mounting bracket being fixed on a structure;

(b) attaching a first end of a spring to a bottom edge of the display sheet;

(c) passing an elongated tool through a hole in a retention bracket such that the tool connects with the second end of the spring, the retention bracket being secured to the structure;

(d) pulling the second end of the spring by use of the tool through the hole in the retention bracket such that the spring is tensioned; and (e) securing the second end of the spring to the retention bracket.

25. A method as recited in claim 24, further comprising the acts of (a) attaching a first end of a second spring to a side edge of the display sheet; and (b) securing a second end of the second spring to a second retention bracket disposed adjacent to the side edge of the display sheet.

26. A method as recited in claim 24, wherein the act of attaching the first end of the spring comprises securing the first end of the spring directly to a retention line positioned along the bottom edge of the display sheet.

27. A method as recited in claim 24, wherein the act of securing the second end of the spring to the retention bracket comprises attaching the second end of the spring to a brace such that the spring biases the brace against the retention bracket.

28. A method as recited in claim 24, wherein the act of securing the second end of the spring to the retention bracket comprises securing the second end of the spring such that the first end of the spring is exposed directly adjacent to the structure so as to enable direct contact betweem the structure and the first end of the spring.

29. An assembly for mounting a flexible display sheet having a first edge and an opposing second edge to a structure, the assembly comprising:

(a) an elongated retention bracket configured for rigid attachment to the structure, the retention bracket having a hole transversely extending therethrough and a substantially L-shaped configuration comprising:

(i) an elongated retention body having a front face and a back face each extending between a top side and an opposing bottom side, the hole extending between the top side and the bottom side; and (ii) a flange outwardly projecting from the front face of the body between the hole and the front face;

(b) a spring having a first end and an opposing second end, the spring being selectively disposed within the hole in the retention bracket, the first end of the spring being configured to couple with the second edge of the display sheet; and (c) means for securing the second end of the spring to the retention bracket.

30. An assembly for mounting a flexible display sheet having a first edge and an opposing second edge to a structure, the assembly comprising:

(a) an elongated retention bracket configured for rigid attachment to the structure, the retention bracket having a hole transversely extending therethrough;

(b) a spring having a first end and an opposing second end, the spring being selectively disposed within the hole in the retention bracket, the first end of the spring being configured to couple with the second edge of the display sheet, the hole in which the spring is disposed extending between a front face on a first side of the retention bracket and a back face on an opposing second side of the retention bracket, the first end of the spring being disposed on the first side of the retention bracket, at least a portion of the second end of the spring openly exposed on the second side of the retention bracket during use; and (c) means for securing the second end of the spring to the retention bracket.

* * * * *

UNITED STATES PATENT AND TRADEMARK OFFICE

CERTIFICATE OF CORRECTION

PATENT NO. : 6,339,889 B1 
DATED : January 22, 2002
INVENTOR(S) : Daniel A. Griesemer and Paul F. Bauer It is certified that error appears in the above-identified patent and that said Letters Patent is hereby corrected as shown below:

Column 2,
Line 59, before “structures” change “desires” to -- desired --

Column 3,
Line 24, after “tension” delete “of”

Column 8,
Line 26, after “mounting bracket” change “SO” to -- 50 --
Line 26, after “retention bracket” change “S2” to -- 52 --

Column 9,
Line 40, before “edges” change “sides” to -- side --
Line 52, before “of the” delete “of”

Column 11,
Line 3, before “through” change “external” to -- externally --
Line 54, before “an opposing” insert -- and --

Column 13,
Line 1, after “contact” change “betweem” to -- between --
Line 10, before “body” delete “retention”

Signed and Sealed this

Nineteenth Day of August, 2003

JAMES E. ROGAN
*Director of the United States Patent and Trademark Office*